US007266534B2

(12) United States Patent
Emek et al.

(10) Patent No.: US 7,266,534 B2
(45) Date of Patent: Sep. 4, 2007

(54) SYSTEM AND METHOD AND PRODUCT OF MANUFACTURE FOR AUTOMATED TEST GENERATION VIA CONSTRAINT SATISFACTION WITH DUPLICATED SUB-PROBLEMS

(75) Inventors: Roy Emek, Tel Aviv-Jaffa (IL); Itai Jaeger, Lavon (IL); Yoav Katz, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/205,969

(22) Filed: Aug. 17, 2005

(65) Prior Publication Data

US 2007/0094184 A1 Apr. 26, 2007

(51) Int. Cl.
*G06N 5/00* (2006.01)

(52) U.S. Cl. ..... 706/45; 706/47; 706/14

(58) Field of Classification Search ..... 706/45, 706/51, 10, 14; 703/7
See application file for complete search history.

(56) References Cited

U.S. PATENT DOCUMENTS 5,088,048 A * 2/1992 Dixon et al. ..... 706/51
5,146,540 A * 9/1992 Natarajan ..... 706/10
5,410,496 A * 4/1995 Bolon et al. ..... 703/7
5,617,510 A 4/1997 Keyrouz et al.
5,636,328 A 6/1997 Kautz et al.
7,085,748 B2 * 8/2006 Emek et al. ..... 706/14
2002/0169587 A1 11/2002 Emek et al.

OTHER PUBLICATIONS

U.S. Appl. No. 11/040,241, filed Jan. 21, 2005.
Kumar, "Algorithms for Constraint Satisfaction Problems: A Survey," *Artificial Intelligence Magazine* 13:1 (1992), pp. 32-44.
Bin et al., "Using a Constraint Satisfaction Formulation and Solution Techniques for Random Test Program Generation," *IBM Systems Journal* 41:3 (2002), pp. 386-402.
Adir et al., "Piparazzi: A Test Program Generator for Microarchitecture Flow Verification," *Eighth IEEE International High-Level Design Validation and Test Workshop* (Nov. 12-14, 2003), pp. 23-28.
Mittal et al., "Dynamic Constraint Satisfaction Problems," *Proceedings of the Eighth National Conference on Artificial Intelligence (AAA1-90)* (Boston, Massachusetts, Jul. 1990), pp. 25-32.

* cited by examiner

*Primary Examiner*—Wilbert L. Starks, Jr.
(74) *Attorney, Agent, or Firm*—Stephen C. Kaufman

(57) ABSTRACT

A computer-implemented method for modeling a target system includes defining a cloned constraint satisfaction problem (CSP) that characterizes the target system in terms of a set of variables and constraints applicable to the variables. The cloned CSP includes a non-predetermined number of duplicate sub-problems corresponding to instances of a repeating feature of the target system. The variables are partitioned so as to define an abstract CSP containing a subset of the variables relating to the duplicate sub-problems. The abstract CSP is solved to generate an abstract solution indicating the number of duplicate sub-problems to use in the cloned CSP. A concrete solution to the cloned CSP is found using the abstract solution.

20 Claims, 5 Drawing Sheets

SYSTEM AND METHOD AND PRODUCT OF MANUFACTURE FOR AUTOMATED TEST GENERATION VIA CONSTRAINT SATISFACTION WITH DUPLICATED SUB-PROBLEMS

FIELD OF THE INVENTION

The present invention relates generally to methods and systems for solving constraint satisfaction problems (CSPs), and specifically to methods for modeling and solution of CSPs comprising sub-problems that may be duplicated an arbitrary number of times.

BACKGROUND OF THE INVENTION

Many of the tasks that are addressed by decision-making systems and artificial intelligence can be framed as constraint satisfaction problems (CSPs). In this framework, the task is specified in terms of a set of variables, each of which can assume values in a given domain, and a set of predicates, or constraints, that the variables must simultaneously satisfy. The set of variables and constraints is referred to as a constraint network. Each constraint may be expressed as a relation, defined over some subset of the variables, denoting valid combinations of their values. A solution to the problem (referred to hereinbelow as a "concrete solution") is an assignment of a value to each variable from its domain that satisfies all of the constraints. CSP solving techniques were surveyed by Kumar in a paper entitled "Algorithms for Constraint Satisfaction Problems: A Survey," *Artificial Intelligence Magazine* 13:1 (1992), pages 32–44.

Constraint satisfaction methods have been found useful in a variety of applications, including:

- Artificial intelligence
- Robotic control
- Temporal reasoning
- Natural language parsing
- Spatial reasoning
- Test-case generation for software and hardware systems
- Machine vision
- Medical diagnosis
- Resource allocation
- Crew scheduling
- Time tabling
- Frequency allocation
- Graph coloring.

For example, Bin et al. describe a constraint satisfaction method for use in automated generation of test programs, in a paper entitled "Using a Constraint Satisfaction Formulation and Solution Techniques for Random Test Program Generation," *IBM Systems Journal* 41:3 (2002), pages 386–402. The authors show how random test program generation can be modeled as a CSP, and they describe a set of solution techniques that are used in practical test-case generation tools. Adir et al. describe a test generator that uses a dedicated CSP solver in a paper entitled "Piparazzi: A Test Program Generator for Micro-architecture Flow Verification," *Eighth IEEE International High-Level Design Validation and Test Workshop* (Nov. 12–14, 2003), pages 23–28. The test generator converts user requests for micro-architectural events into test programs. Further aspects of the use of CSP solving in automatic test-case generation are described in U.S. Patent Application Publication 2002/0169587 A1.

A number of other constraint satisfaction systems are described in the patent literature. For example, U.S. Pat. No. 5,636,328 describes methods and apparatus for finding values that satisfy a set of constraints, applied particularly to control of a robotic arm. U.S. Pat. No. 5,617,510 describes a method, useful in computer-aided design, of identifying possible solutions to an over-constrained system having a collection of entities and constraints.

The concept of a CSP was generalized by Mittal et al. to cover more complex problems in which variables may be active or inactive, in a paper entitled "Dynamic Constraint Satisfaction Problems," *Proceedings of the Eighth National Conference on Artificial Intelligence* (AAAI-90) (Boston, Mass., July 1990), pages 25–32. This generalization is commonly referred to as "Conditional CSP," or CondCSP. In contrast to the traditional definition of a CSP, a variable in a CondCSP can be either active or inactive. The variable is assigned a value only if it is active. The CondCSP includes compatibility constraints, which specify the set of allowed combinations of values for a set of variables, and activity constraints, which determine whether a given variable is active. A compatibility constraint is active only if all its variables are active. A solution to a CondCSP contains (a) a set of active variables and (b) a value assignment to all the active variables, in which each variable is assigned a value from its domain. The assignment and the set of active variables must satisfy all the activity constraints and all the active compatibility constraints.

SUMMARY OF THE INVENTION

There is therefore provided, in accordance with an embodiment of the present invention, a computer-implemented method for modeling a target system. The method includes defining a cloned constraint satisfaction problem (CSP) that characterizes the target system in terms of a set of variables and constraints applicable to the variables, wherein the cloned CSP includes a non-predetermined number of duplicate sub-problems corresponding to instances of a repeating feature of the target system. To solve the cloned CSP, the variables are partitioned so as to define an abstract CSP containing a subset of the variables relating to the duplicate sub-problems. This abstract CSP is solved to generate an abstract solution indicating the number of duplicate sub-problems to use in the cloned CSP. A concrete solution to the cloned CSP is then found using the abstract solution. Apparatus and computer software products for defining and solving a cloned CSP are also provided.

The present invention will be more fully understood from the following detailed description of the embodiments thereof, taken together with the drawings in which:

DETAILED DESCRIPTION OF EMBODIMENTS

System Overview

Figure 1:
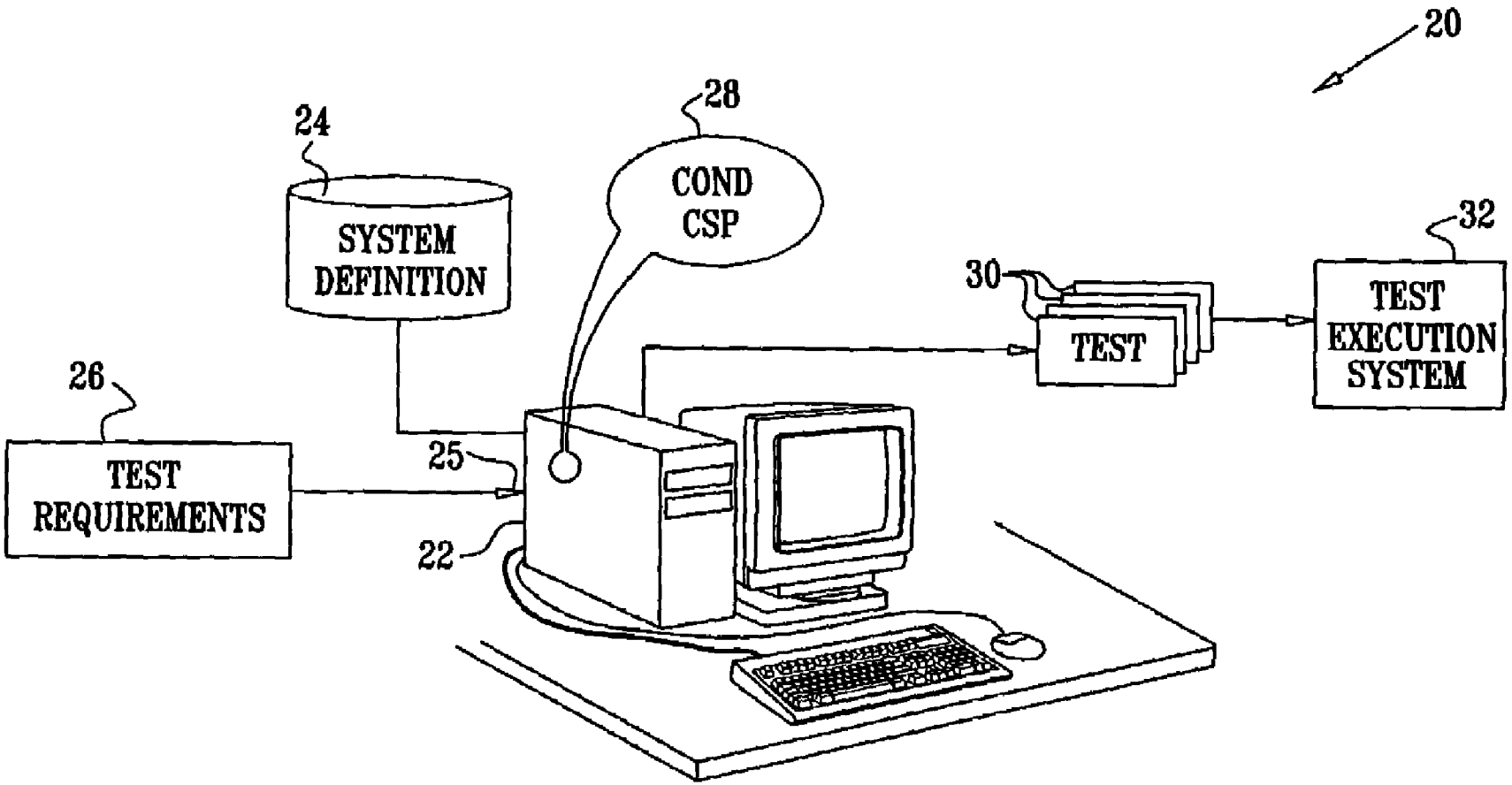
FIG. 1 is a schematic, pictorial illustration of a system for automatic test generation based on CSP solving, in accordance with an embodiment of the present invention.

FIG. 1 is a block diagram that schematically illustrates a testing system 20, in accordance with an embodiment of the present invention. System 20 is built around an automated test generator 22, which receives a definition 24 of a target system and a specific set of test requirements 26 to be applied to the target system, via an input interface 25. Definition 24 is typically expressed in terms of a set of variables and constraints to be applied to those variables. Test requirements 26 typically comprise additional constraints, such as domain limitations, to be applied by generator 22 in producing test cases 30. The test requirements may be input in various forms, for example, in the form of a user-generated test template. Input interface 25 may thus comprise, for example, a user interface or a communication interface for receiving input information from another computer, or a combination of these elements.

The nature of the testing to be carried out, as dictated by definition 24 and test requirements 26, may include multiple instances of some feature of the target system, such as multiple instances of a repeating task or other function to be performed by a certain unit in the target system. The number of instances is not predetermined, i.e., it is not necessarily defined in advance and may be allowed to vary arbitrarily over some range. An example of this sort of test is described hereinbelow with reference to FIGS. 2–4. To deal with this sort of testing, test generator 22 frames the variables and constraints in the form of a novel sort of CSP, with multiple sub-problems (as shown below in FIG. 5, for example). This type of CSP, in which the number of sub-problems is non-predetermined, is referred to herein as a "cloned CSP." Test generator comprises a CSP solver 28, which finds test cases 30 by solving this cloned CSP. In other words, each test case found by generator 22 is a (random) concrete solution to the clone CSP, giving values of the variables that satisfy all of the constraints.

In one embodiment of the present invention, for example, the variables provided by system definition 24 comprise possible inputs to a hardware device or software program under development. These inputs are typically instructions, addresses and possibly other properties that would be input to the device or program in the course of actual operation. Generator 22 uses test requirements 26 provided by the operator, together with constraints that it computes automatically itself, to determine test cases 30 in the form of combinations of instructions and addresses to use as test inputs to the device. These inputs may then be applied to the device or program itself, or (as shown in FIG. 1) to a test execution system 32, such as a simulator for pre-production verification of the design of the device or program.

Typically, test generator 22 comprises a general-purpose or dedicated computer, programmed with suitable software for carrying out the functions described herein. The software may be supplied to the computer in electronic form, over a network or communication link, for example, or it may be provided on tangible media, such as CD-ROM or DVD. Further aspects of automatic test generation using CSP solutions are described in U.S. patent application Ser. Nos. 11/092,000 and 11/040,241, which are assigned to the assignee of the present patent application and whose disclosures are incorporated herein by reference.

Although the embodiments described hereinbelow relate specifically to test-case generation, the principles of the present invention may be applied in solving a wide range of other types of constraint satisfaction problems. CSP solver 28 may be adapted, either in the configuration of a stand-alone computer or integrated with other input and output devices, to carry out substantially any function that can be associated with a constraint network. Some examples of such functions are listed in the Background of the Invention. Exemplary applications include controlling a robot based on sensor inputs; analyzing visual or spatial information to identify and characterize objects in an image; parsing natural language input to interpret its meaning; suggesting medical diagnoses based on symptoms and test results; determining resource allocations and scheduling; belief maintenance; temporal reasoning; graph problems; and design of floor plans, circuits and machines. Other applications will be apparent to those skilled in the art.

Problem Definition

Figure 2:
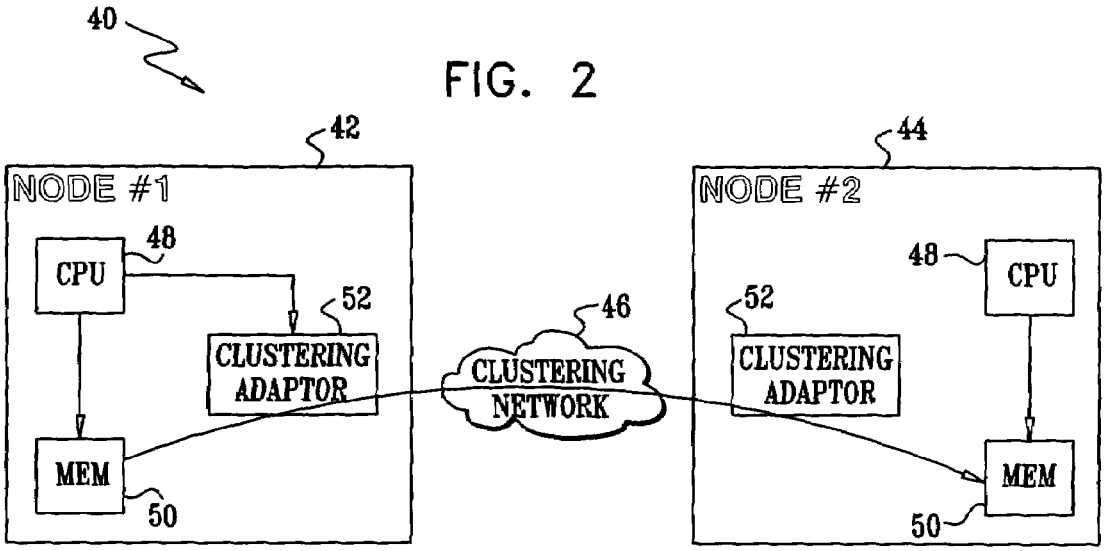
FIG. 2 is a block diagram that schematically illustrates a target computer system for which a test is to be generated in accordance with an embodiment of the present invention.

FIG. 2 is a block diagram that schematically illustrates a target system 40 for which tests 30 are to be generated by test generator 22, in accordance with an embodiment of the present invention. In system 40, two computing nodes 42 and 44 and linked through a clustering network 46. Each node has a respective central processing unit (CPU) 48, memory 50, and clustering network adaptor 52. In such systems, it is common for large amounts of data to be moved from one node to another over network 46. To reduce the burden on CPUs 48, adaptors 52 may comprise dedicated data movers for this purpose. In the example that follows, it is assumed that this data moving function is to be tested.

Figure 3:
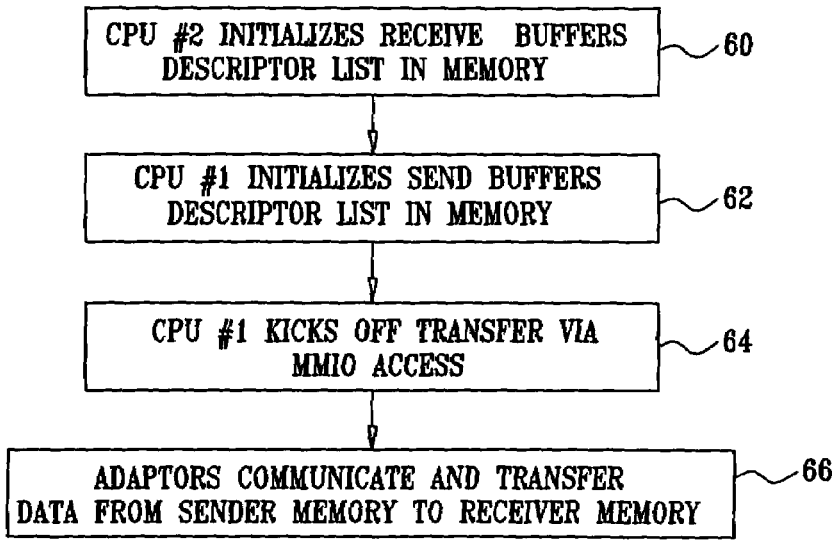
FIG. 3 is a sequence of events to be modeled by automatic test generation in accordance with an embodiment of the present invention.

FIG. 3 is a flow chart that schematically illustrates the data moving process that is to be tested by system 20 in this exemplary embodiment. In this example, it is assumed that node 42 is to transfer data to node 44. In preparation for the data transfer, CPU 48 of node 44 prepares a receive descriptor list in memory 50 of node 44, at a receive buffer initialization step 60. This list will indicate to adaptor 52 of receiving node 44 the locations in the memory to which the data transferred from node 42 are to be written. CPU 48 of node 42 prepares a transmit descriptor list in the memory of node 42, at a transmit buffer initialization step 62. An exemplary list of this sort is shown below in FIG. 4.

Once the descriptors are ready, CPU 48 of node 42 initiates data transfer, at a kickoff step 64. At this step, the CPU informs adaptor 52 that there is a descriptor list waiting in a specified location in memory 50, and instructs the adaptor to move the data. The data mover in adaptor 52 of node 42 goes to the head of the transmit descriptor list, reads the first entry, and transfers the data from the memory locations indicated by this entry to node 44, at a data transfer step 66. After completing the first descriptor, the data mover proceeds to execute the next descriptor, and so on until the end of the list. Upon receiving each segment of the data, the adaptor of node 44 reads the next descriptor from the receive descriptor list and places the data in the memory location indicated by the descriptor.

Figure 4:
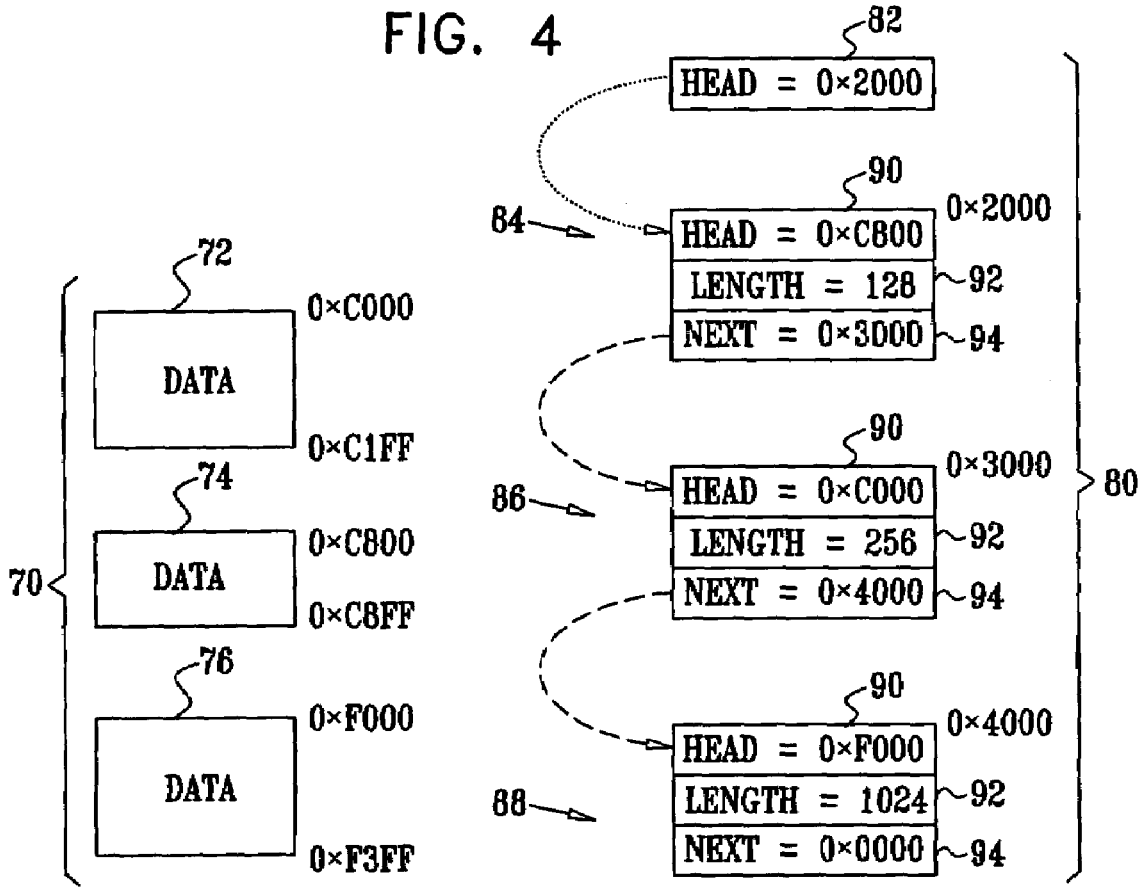
FIG. 4 is a block diagram that schematically illustrates a set of memory buffers and descriptors used in transferring data between memories in a computer system.

FIG. 4 is a block diagram that schematically illustrates transmit buffers 70 and a transmit descriptor list 80, which are used in the data moving process of FIG. 3. Buffers 70 comprise memory blocks 72, 74 and 76 in which the data to be transferred are stored. The blocks need not be contiguous and are not necessarily of equal size. The number of blocks transferred at step 66 (as determined by the number of descriptors in the list prepared by the CPU) may also vary. Typically, the protocol defines maximal (and possibly minimal) numbers of blocks to transfer, maximal and minimal block sizes, and maximal total data length to be transferred in one operation.

Descriptor list 80 in this example has the form of a linked list. A head entry 82 (to which CPU 48 directs adaptor 52 at step 64) points to the memory address (0x2000 in this example) at which a first descriptor 84 is stored. Descriptor 84 comprises three fields: an address 90, pointing to the beginning of the corresponding data block (in this case block 74, at 0xC800); a length 92, giving the size of the data block; and a next pointer 94, indicating the address at which the next descriptor is written. Adaptor 52 reads pointer 94 to find a second descriptor 86 (at address 0x3000), which in turn points to a final descriptor 88. Next pointer 94 of final descriptor 88 is null, indicating to adaptor 52 that this is the end of the list.

In order to test the mechanism of FIG. 3, test generator 22 generates multiple test cases 30, each with a different descriptor list 80. It is desirable that the set of descriptor lists included in the test cases span the ranges of numbers and sizes of buffers 70 that are permitted by the protocol. In other words, different tests may have different numbers of descriptors, and the descriptors may point to data blocks of different lengths. The number of descriptors and individual descriptor sizes may be mutually constrained by the total permitted data length of the entire transfer. (For example, if the total data length is eight, the transfer may consist of two blocks of size four or four blocks of size two.) In other words, the number of descriptors is itself a constrained variable in the CSP corresponding to target system 40, and the descriptor number variable is a part of the predicate of constraints on other variables. CSP solvers known in the art do not provide efficient methods for solving this sort of problem, while still permitting the variables to vary freely, at random, over their respective ranges, as is desirable in large-scale test generation.

Method of Solution

Test generator 22 frames the type of situation exemplified by FIGS. 2–4 as a cloned CSP. It solves the cloned CSP using a conditional CSP (CondCSP) formalism. In other words, when faced with a situation in which the problem being modeled may include a variable number of instances of some feature (such as the descriptors of FIG. 4), CSP solver 28 constructs a cloned CSP comprising multiple, duplicate, conditional sub-problems, one for each possible instance, up to the maximum permitted number of instances. The CSP solver partitions the constraint network of the cloned CSP into abstract and concrete problems. The abstract problem is a CondCSP, which comprises a subset of the variables in the cloned CSP that influence the multiplicity of the instances, i.e., the variables whose values may determine the number of sub-problems that are active in a given concrete solution of the CSP.

The CSP solver then solves the abstract problem in order to determine an abstract solution, i.e., a solution to the CondCSP, which includes assignment of values to the variables in the abstract problem. The abstract solution gives a value of the multiplicity and compatible values of the associated variables. In the abstract solution, the conditionality of the sub-problems is resolved, i.e., the activity status (active or inactive) of each of the duplicate sub-problems is known, since the multiplicity value indicates the number of active sub-problems. The remaining sub-problems are inactive and may be eliminated from the current solution. The abstract solution is then used as the basis for finding a concrete solution of the complete CSP. This approach permits the multiplicity values to be chosen at random, while facilitating efficient computation of full solutions that maintain the mutual influence of the multiplicity on the other problem variables and vice versa.

Figure 5:
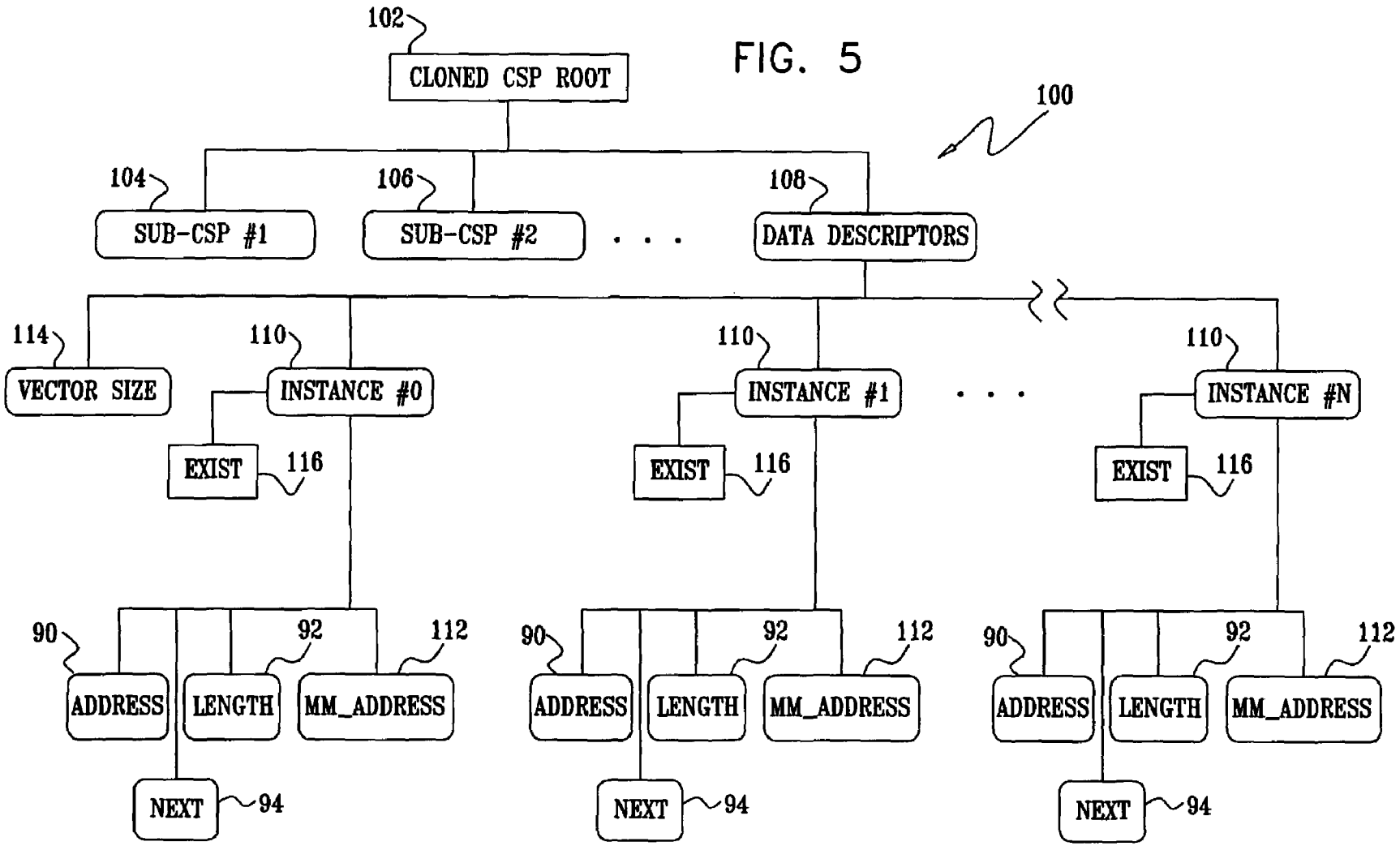
FIG. 5 is a graph that schematically illustrates a CSP with duplicated sub-problems, in accordance with an embodiment of the present invention.

FIG. 5 is a graph 100 that schematically illustrates the above-mentioned construction and partitioning of the conditional CSP constraint network, in accordance with an embodiment of the present invention. The graph refers to the exemplary test situation described above with reference to FIGS. 2–4. CSP solver 28 models the constraint network as a hierarchy of sub-CSPs, with respective sub-CSP roots 104, 106, . . . , 108, below a cloned CSP root 102. A general formalism of this sort of hierarchical construction in the context of a CondCSP is described, for example, in a patent application Ser. No. 11/205,527 by Geller et al., entitled "Solving constraint satisfaction problems with duplicated sub-problems," filed on even date, which is assigned to the assignee of the present patent application and whose disclosure is incorporated herein by reference.

In the example shown in FIG. 5, the sub-CSP below root 108 contains the variables and constraints relating to descriptor list 80 (FIG. 4). The CSP solver adds N duplicate sub-problem instances 110 below root 108, wherein N is a predefined upper bound on the number of instances (for example, the number of descriptors in list 80). In some cases, such as the present example, the sub-problems are arranged in a sequential order, corresponding to the order of the features of the target system that they represent. The leaves of each sub-problem instance correspond to the sub-problem variables, such as the descriptor address 90, length 92 and next pointer 94. Other relevant variables, such as a memory-mapped address 112 of each descriptor, are also added to each sub-problem.

A vector size 114 is added as a variable below sub-problem root 108. The vector size is an integer variable, which indicates how many of sub-problem instances 110 are active in a given solution. For ease of solution, an existence variable 116 is added as a leaf to each sub-problem instance. The existence variable is TRUE if the corresponding sub-problem is active, and FALSE otherwise. The use of this sort of existence variables in CondCSP solving is described in detail in the above-mentioned patent application by Geller et al. In the present example, for sub-problem [i] and vector size n, the existence variable is TRUE for $i \leqq n$ and FALSE otherwise. Alternatively or additionally, other CondCSP formalisms, as are known in the art, may be used to represent the number of sub-problems and the activity constraints on each of the sub-problems.

Each sub-problem instance includes all the constraints that apply to the sub-problem variables within the instance, i.e., the constraints applicable to address 90, length 92, next pointer 94 and memory-mapped address 112 in the present example. In addition, system definition 24 and test requirements 26 may comprise constraints that depend on the overall structure of the array of sub-problems below root 108. Constraints of this general type are referred to herein as "vector constraints." These vector constraints may, for example, include constraints over multiple sub-problem instances, as well as constraints applicable to certain instances because of their position in the sequence of sub-problems, such as constraints pertaining to the first or last instance. Multi-instance constraints may include second-order logic quantifiers, such as "for each" to express repeating relations, and "all" to refer globally to all the active sub-problems. Examples of these sorts of vector constraints include:

Linked-list consistency:

dd [i] .next=dd [i+1] .mm_address for all i≦n−1

Linked-list termination:

dd [n−1] .next=0

Array consistency:

dd [i+1] .mm_address=dd [i] mm_address+const for all i<n−1

Address alignment:

(dd [i] .length=16)→dd [i] .address & 0x000 F=0x0000 for all i<n

Total length:

$$\text{total_length}=\sum_i dd[i]\cdot\text{length}$$

Figure 6:
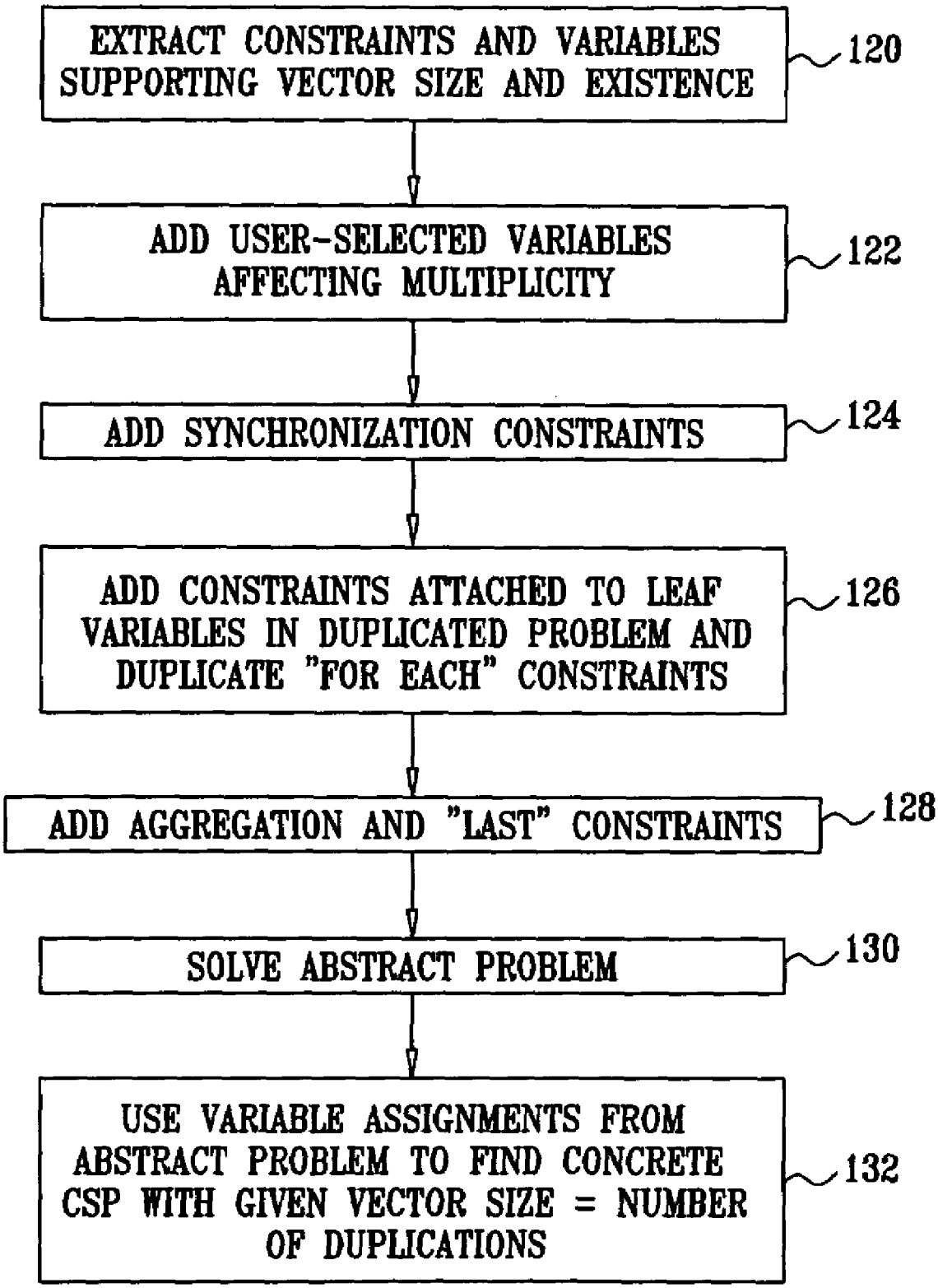
FIG. 6 is a flow chart that schematically illustrates a method for solving a CSP with duplicated sub-problems, in accordance with an embodiment of the present invention.

FIG. 6 is a flow chart that schematically illustrates a method for solving a cloned CSP with multiple sub-problem instances, in accordance with an embodiment of the present invention. This method will be explained with reference to the problem presented in FIGS. 2–5. It will be understood, however, that this particular type of test generation is described here only by way of example, and the principles embodied in this method may similarly be applied to other types of CSPs with multiple sub-problem instances.

In order to define the abstract CSP with respect to the multiple conditional sub-problems, CSP solver 28 extracts from the total constraint network of the complete CSP all the constraints that support vector size 114 and existence variables 116 (i.e., all the constraints that directly affect the values of the size and existence variables), at a constraint extraction step 120. For each of these constraints, the CSP solver also extracts the other variables that are connected to the constraint. A user of system 20 may specify additional variables that are believed to influence the sub-problem multiplicity, at a user selection step 122. This step permits the user's intuition regarding the problem structure to be brought to bear, specifically with regard to variables that are likely to affect the multiplicity, even if they are not directly linked by constraints to the vector size. These user-selected variables are also added to the abstract CSP.

A synchronization constraint is added to the abstract CSP at a synchronization step 124, in order to synchronize the vector size and existence variables during solution of the abstract CSP. The semantics of the synchronization constraint are as follows: For S=current domain of the vector size variable, with m=min(S) and n=max(S), then for each k>n existence[k]=FALSE, and for each j<m existence[j] =TRUE.

To complete the constraint network of the abstract CSP, all the constraints from the complete CSP that connect the leaves (variables) in the abstract CSP are added to the abstract CSP, at a constraint addition step 126. In addition, any "for each" constraints in the abstract CSP are duplicated as an individual constraint on each of instances 110. If these individual constraints cause inconsistency within any of the sub-problems, they will cause the existence variable of that sub-problem to be set to FALSE when the abstract CSP is solved. The FALSE existence variable, in turn, will limit the possible values of the vector size.

Constraints on aggregate values taken over all the sub-problems (referred to herein as aggregate constraints) and constraints on the "last" sub-problem are added into the abstract CSP, at a constraint wrapping step 128. These constraints cannot simply be attached to the variables in any particular sub-problem, since the vector size (and hence the last sub-problem) is not known in advance. Therefore, CSP solver 28 builds a "wrapper constraint" to replace each of the aggregate and "last" constraints. The wrapper constraint has the form of a disjunction over all possible values of the vector size. For example, a constraint of the form of the total length (TL) constraint listed above would be expressed as follows:

$$(vs=1\wedge TL=L[1])\vee(vs=2\wedge TL=L[1]+L[2])\vee K\vee(vs=N\wedge TL=L[1]+L[2]+K+L[N])$$

wherein vs is the vector size, and L[k] is the value of the "length" variable in sub-problem k. "Last" constraints may be restated in like fashion.

After constructing the abstract constraint network in steps 120–128, CSP solver 28 solves the abstract CSP, at an abstract solution step 130. The abstract CSP is a CondCSP, as defined above, and any suitable method of CondCSP solution may be used at step 130. One such method is described in the above-mentioned patent application by Geller et al. Another method is described in U.S. patent application Ser. No. 11/040,241, filed Jan. 21, 2005, which is assigned to the assignee of the present patent application and whose disclosure is incorporated herein by reference.

The solution to the abstract CSP gives a value of the vector size, as well as values of the other variables in the abstract CSP that are compatible with this vector size. Using this information, CSP solver 28 builds a static (non-conditional) CSP that contains the number of sub-problem instances 110 indicated by the vector size value, at a concrete solution step 132. The variables that were assigned values in the abstract solution keep the same values in the static CSP. The CSP solver finds an assignment of all the remaining variables that solves the static CSP. Test generator 22 then outputs this assignment as one of test cases 30.

As noted earlier, although the embodiments described above relate specifically to the field of test generation, the novel principles of CSP formulation and solution that are embodied in test generator 22 may similarly be applied in other areas in which CSP solving is used. It will thus be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. A method for controlling a target computerized system, comprising:

defining a cloned constraint satisfaction problem (CSP) that characterizes the target computerized system in terms of a set of variables relevant to the computerized system and constraints applicable to the variables, the cloned CSP comprising a non-predetermined number of duplicate sub-problems corresponding to instances of a repeating feature of the target system;

partitioning the variables so as to define an abstract CSP containing a subset of the variables relating to the duplicate sub-problems;

solving the abstract CSP to generate an abstract solution indicating the number of duplicate sub-problems to use in the cloned CSP;

finding a concrete solution to the cloned CSP using the abstract solution; and applying a control input to the target computerized system based on the concrete solution.

2. The method according to claim 1, wherein defining the cloned CSP comprises adding to the set a vector size variable that indicates the number of duplicate sub-problems, and adding at least one constraint on the vector size variable, and wherein solving the abstract CSP comprises processing the at least one constraint in order to assign a value to the vector size variable.

3. The method according to claim 2, wherein defining the cloned CSP comprises adding to the set Boolean existence variables that indicate an activity status of each of at least some of the duplicate sub-problems, and wherein adding the at least one constraint comprises defining constraints between the vector size variable and the existence variables.

4. The method according to claim 2, wherein partitioning the variables comprises adding to the subset one or more of the variables that are selected from at least one of a first group of the variables consisting of the variables that are connected by constraints to the vector size variable and a second group of the variables that a human user indicates are likely to affect the vector size variable.

5. The method according to claim 1, wherein defining the cloned CSP comprises defining a vector constraint over the duplicate sub-problems, and wherein solving the abstract CSP comprises applying the vector constraint to one or more of the variables in at least one of the duplicate sub-problems.

6. The method according to claim 5, wherein the duplicate sub-problems are arranged in a sequential order, and the vector constraint depends on the sequential order, and wherein applying the vector constraint comprises connecting the vector constraint to the one or more of the variables responsively to the sequential order.

7. The method according to claim 1, wherein the cloned CSP comprises activity constraints, and wherein solving the abstract CSP comprises resolving the activity constraints so that no activity constraints remain to be resolved in finding the concrete solution.

8. The method according to claim 1, wherein solving the abstract CSP comprises finding multiple abstract solutions with different numbers of the duplicate sub-problems, and wherein finding the concrete solution comprises finding multiple concrete solutions with the different numbers of the duplicate sub-problems.

9. The method according to claim 1, wherein the target system comprises an electronic system comprising a processor, and wherein finding the concrete solution comprises determining parameters of a command to be input to the processor.

10. A computer-implemented method for automatic test generation, comprising:

defining a cloned constraint satisfaction problem (CSP) that characterizes an electronic system comprising a processor in terms of a set of variables relevant to the electronic system and constraints applicable to the variables, the cloned CSP comprising a non-predetermined number of duplicate sub-problems corresponding to instances of a repeating task to be carried out by the processor;

partitioning the variables so as to define an abstract CSP containing a subset of the variables relating to the duplicate sub-problems;

solving the abstract CSP to generate an abstract solution indicating the number of duplicate sub-problems to use in the cloned CSP;

finding a concrete solution to the cloned CSP using the abstract solution so as to determine parameters of a command that will cause the processor to perform the indicated number of repetitions of the task; and applying the command to test a design of the electronic system.

11. The method according to claim 10, wherein finding the concrete solution comprises generating the indicated number of descriptors in a linked list for input to the processor.

12. Apparatus for controlling a target computerized system, comprising:

an input interface, which is arranged to receive a definition of a cloned constraint satisfaction problem (CSP) that characterizes the target computerized system in terms of a set of variables relevant to the computerized system and constraints applicable to the variables, the cloned CSP comprising a non-predetermined number of duplicate sub-problems corresponding to instances of a repeating feature of the target system; and a CSP processor, which is arranged to partition the variables so as to define an abstract CSP containing a subset of the variables relating to the duplicate sub-problems, to solve the abstract CSP to generate an abstract solution indicating the number of duplicate sub-problems to use in the cloned CSP, and to find a concrete solution to the cloned CSP using the abstract solution, and to generate a control input for application to the target computerized system based on the concrete solution.

13. The apparatus according to claim 12, wherein the CSP processor is arranged to add to the set of variables a vector size variable that indicates the number of duplicate sub-problems, and to add at least one constraint on the vector size variable, and to process the at least one constraint while solving the abstract CSP in order to assign a value to the vector size variable.

14. The apparatus according to claim 12, wherein the cloned CSP comprises a vector constraint over the duplicate sub-problems, and wherein the CSP processor is arranged to solve the abstract CSP comprises by applying the vector constraint to one or more of the variables in at least one of the duplicate sub-problems.

15. The apparatus according to claim 12, wherein the cloned CSP comprises activity constraints, and wherein the CSP processor is arranged to resolve the activity constraints while solving the abstract CSP comprises so that no activity constraints remain to be resolved in finding the concrete solution.

16. The apparatus according to claim 12, wherein the CSP processor is arranged to find multiple abstract solutions with different numbers of the duplicate sub-problems, and to find multiple concrete solutions using the abstract solutions with the different numbers of the duplicate sub-problems.

17. A computer software product for controlling a target computerized system, the product comprising a computer-readable medium in which program instructions are stored, which instructions, when read by a computer, cause the computer to receive a definition of a cloned constraint satisfaction problem (CSP) that characterizes the target computerized system in terms of a set of variables relevant to the computerized system and constraints applicable to the variables, the cloned CSP comprising a non-predetermined number of duplicate sub-problems corresponding to instances of a repeating feature of the target system, and to partition the variables so as to define an abstract CSP containing a subset of the variables relating to the duplicate sub-problems, to solve the abstract CSP to generate an abstract solution indicating the number of duplicate sub-problems to use in the cloned CSP, and to find a concrete solution to the cloned CSP using the abstract solution, and to generate a control input for application to the target computerized system based on the concrete solution.

18. The product according to claim 17, wherein the instructions cause the computer to add to the set of variables a vector size variable that indicates the number of duplicate sub-problems, and to add at least one constraint on the vector size variable, and to process the at least one constraint while solving the abstract CSP in order to assign a value to the vector size variable.

19. The product according to claim 17, wherein the cloned CSP comprises a vector constraint over the duplicate sub-problems, and wherein the instructions cause the computer to solve the abstract CSP comprises by applying the vector constraint to one or more of the variables in at least one of the duplicate sub-problems.

20. The product according to claim 17, wherein the cloned CSP comprises activity constraints, and wherein the instructions cause the computer to resolve the activity constraints while solving the abstract CSP comprises so that no activity constraints remain to be resolved in finding the concrete solution.

* * * * *